US005731517A

United States Patent [19]

Ma et al.

[11] Patent Number: 5,731,517

[45] Date of Patent: Mar. 24, 1998

[54] MEASURING DEVICE USED IN A FOUR-PARAMETER MEASURING SYSTEM AND IN A HIGH TEMPERATURE AND HIGH PRESSURE CONDITION

[75] Inventors: Donglan Ma, Liaoning Province; Zonghu Lin, Xian; Zulian Qiu, Xian; Dong Wang, Xian; Baoyan Xu, Liaoning Province; Dazhong Chen, Liaoning Province; Yewei Zhao, Liaoning Province; Yu Zheng, Liaoning Province, all of China

[73] Assignee: Liaohe Petroleum Exploration Bureau, Liaoning Province, China

[21] Appl. No.: 683,357

[22] Filed: Jul. 18, 1996

[30] Foreign Application Priority Data

Jun. 7, 1996 [CN] China ..... 96226526

[51] Int. Cl.[6] ..... E21B 47/06; E21B 33/124; E21B 47/00; G01K 17/06

[52] U.S. Cl. ..... 73/152.01; 73/152.22; 73/152.52; 73/152.12; 166/252; 374/42; 374/136; 374/45

[58] Field of Search ..... 73/152.01, 152.02, 73/152.52, 152.39, 152.22, 152.18, 152.12; 166/250, 252; 374/42, 45, 136

[56] References Cited

U.S. PATENT DOCUMENTS

| | | | |
|---|---|---|---|
| 3,011,342 | 12/1961 | Simm | 73/155 |
| 3,616,689 | 11/1971 | Scholberg | 73/154 |
| 4,326,411 | 4/1982 | Gant et al. | 73/155 |
| 4,455,875 | 6/1984 | Guimard et al. | 73/708 |
| 4,458,520 | 7/1984 | Adame | 73/38 |
| 4,479,383 | 10/1984 | Bravenec | 73/151 |
| 4,542,993 | 9/1985 | Mims et al. | 374/42 |
| 4,558,592 | 12/1985 | Despax et al. | 73/151 |
| 4,581,926 | 4/1986 | Moore et al. | 73/155 |
| 4,712,006 | 12/1987 | Zemel et al. | 250/269 |
| 4,817,713 | 4/1989 | Nguyen et al. | 166/252 |
| 4,893,505 | 1/1990 | Marsden et al. | 73/155 |
| 4,901,563 | 2/1990 | Pearson | 73/151 |
| 4,976,142 | 12/1990 | Perales | 73/155 |
| 5,350,018 | 9/1994 | Sorem et al. | 166/250 |
| 5,509,478 | 4/1996 | Stoy | 166/250.06 |

FOREIGN PATENT DOCUMENTS 92237200.5 4/1994 China .

*Primary Examiner*—Hezron E. Williams
*Assistant Examiner*—J. David Wiggins
*Attorney, Agent, or Firm*—Panitch Schwarze Jacobs & Nadel, P.C.

[57] ABSTRACT

A measuring device used in a four parameter measuring system for measuring simultaneously temperature, pressure, flow rate and steam quality of steam injection profiles during heavy oil recovery by steam injection, comprising: a cable cap, arranged at the top of the device; a measuring section, connected with the cable cap and comprising a metal case, three first pressure sensors and a thermoelectric couple; the first pressure sensors and the thermoelectric couple being longitudinally arranged in the case; a thermal protection section used for safe transmission of the data measured by the sensors and the couple; a thermal isolating section connected to the lower part of the section and a data acquisition, conversion and storage system under the control of the single-chip processor. The pressure and temperature data measured respectively are transmitted to the data acquisition, conversion and storage system and stored therein, so that the temperature, pressure, flow rate and steam quality can be calculated after the device is raised through the borehole in its return to the ground.

10 Claims, 5 Drawing Sheets

MEASURING DEVICE USED IN A FOUR-PARAMETER MEASURING SYSTEM AND IN A HIGH TEMPERATURE AND HIGH PRESSURE CONDITION

INTRODUCTION

The present invention relates to a device used in oilfield, and especially to a data acquisition and storage device used as a part of a measuring system for accurate measurement of temperature, pressure, flow rate and steam quality of steam injection profiles during heavy crude recovery by steam injection.

BACKGROUND OF THE INVENTION

Generally, HUFF & PUFF and steam drive are the most economical and effective method for heavy oil recovery. Change of downhole parameters during injection and the conditions of steam injection profiles for different pay zones show directly the sweep efficiency, to which the effect of heavy oil reservoir and production are closely related.

In order to analyze accurately the performance of the heavy oil reservoir, four downhole parameters ,temperature, pressure, flow rate and steam quality, must be accurately measured.

Many systems have been invented to provide the measurement, however, short falls and disadvantages have been found in those prior measuring systems.

A measuring system is disclosed in Chinese patent 92237200.5, which was issued on Apr. 13, 1994, entitled "Vacuum Heat Isolating Measuring System used in Steam Injection Profiles" and was assigned to the assignee of the present application. Referring to FIG. 4 of the present application the system of the Chinese patent comprises a downhole device including a detecting assembly, a high temperature proof bottle assembly, a signal converting assembly and a downhole data storage system under the control of a signal chip processor, and a ground main microprocessor.

The detecting assembly consists of a measuring probe 2*a*, a flow stabilizing section 3*a*, a plurality of signal transmitting pipes 4*a*, a cable cap 5*a*, a position-adjusting member 6*a* and an upper sealing joint 7*a*. The measuring probe 2*a* is constructed with a plurality of flute-shaped robes.

Small holes 1*a* are formed on each of the flutes for measurement of hydrodynamic pressures of two phase flows. The flow stabilizing section 3*a* has a shape of a hollow cylinder with holes in its side wall for sensing the static pressure in a well bore. The pipes 4*a* are elongated and used to transmit both hydrodynamic pressure signals from the detecting probe 2*a* and static pressure signals sensed in the section 3*a* to the high temperature proof bottle assembly. The cable cap 5*a* has its one end connected to the section 3*a*. A cable used to hang the downhole device into the well bore extends through the middle of the cap 5*a* and is fixed therein.

The high temperature proof bottle assembly consists of a heat isolating plug 9*a* and a bottle body 8*a*. The latter has a two-wall structure consisting of an outer wall and an inner will. Vacuum is formed between the walls and has a function of thermal isolation.

The signal converting assembly comprises pressure differential converters 10*a*, pressure converters 11*a* and a signal transmitting unit. A temperature sensing component 12*a* which is a platinum thermal resistance senses the temperament and transmits the temperature signals to the signal converting assembly. The downhole data storage system comprises a single chip processor, an I/O connector, a multilayer circuit board and sampling software. The sampling software in the single chip processor collects the data of predetermined locations of the well bore and stores them in RAM.

The above mentioned system uses a probe constructed with a plurality of flutes, which results in the following disadvantages:

1. The movement of the measuring device is often hindered, because its moving direction is vertical to the extending direction of the flutes.

2. Since the cable cap is arranged under the probe, the cable has to, in use, run through the probe and divides the probe into two parts, which damages the measuring precision of the probe.

3. When the cable for hanging is broken and the device falls into the well bore, a tool has to be used to drag the device out of the well and the flutes are often damaged by the catch of the dragging tool, because the probe is located at the upper part of the device.

4. Although the high temperature proof bottle of the prior device can prevent heat from outside from entering, in practice, because of the bad-distribution of the electronic components, the heat produced by these electronic components will result in a local heat concentration in the bottle, which affects the working performance of the device.

5. Under a high temperature condition in a long time, the sealing effect of the bottle plug of the above mentioned bottle assembly can not reach practical working requirements.

Therefore, it is an object of the invention to provide a measuring device having a sensing part without hampering the movement of the whole device.

It is another object of the invention to provide a measuring device in which the hanging cable will not affect the measurement.

It is yet another object of the invention to provide a measuring device which will not be damaged by forces from the dragging tool when attempting to recover the device from the well bore.

It is still another object of the invention to provide a measuring device having an uniform temperature distribution in the heat isolating bottle.

It is a further object of the invention to provide a measuring device with a good sealing plug to ensure a long term measurement life under high pressure.

SUMMARY OF THE INVENTION

According to the present invention, there is to provide a measuring device used in a four parameter measuring system for measuring simultaneously temperature, pressure, flow rate and steam quality of steam injection profiles during heavy oil recovery by steam injection, comprising: a cable cap arranged at the top of the device; a measuring section connected with the cable cap and comprising a metal case, three first pressure sensors for pressure measurement, and a thermoelectric couple; the first pressure sensors and the thermoelectric couple being longitudinally arranged in the case; a plurality of isolation lids being attached on the first sensors to form sensing spaces for the first sensors; the sensing spaces being airtightly sealed from other parts in the case; a plurality of holes being formed respectively in the isolation lids and the case for the communication of the sensing spaces to the outside; a thermal protection section connected to the lower part of said section and used for safe transmission of the data measured by the sensors and the couple; a thermal isolating section, connected to the lower part of the section; and, a data acquisition, conversion and storage system comprising a second pressure sensor for receiving the pressure data measured by one of the first pressure sensors in said section, a plurality of pressure differential sensors for receiving the pressure data measured by each pair of any two of the first pressure sensors and producing pressure differential data, a temperature sensor for receiving temperature data given by the thermal couple and a conversion and storage system under the control of the single-chip processor. The pressure and temperature data measured respectively by the pressure sensors and the thermoelectric couple are transmitted to the data acquisition, conversion and storage system and stored therein, so that the temperature, pressure, flow rate and steam quality can be calculated after the device is raise through said borehole in its return to the ground.

Further objects and advantages of the invention will appear from the following description taken together with the accompanying drawings.

BRIEF DESCRIPTION OF THE ACCOMPANYING DRAWINGS

DETAILED DESCRIPTION OF THE PREFERRED EMBODIMENT

Figure 1A:
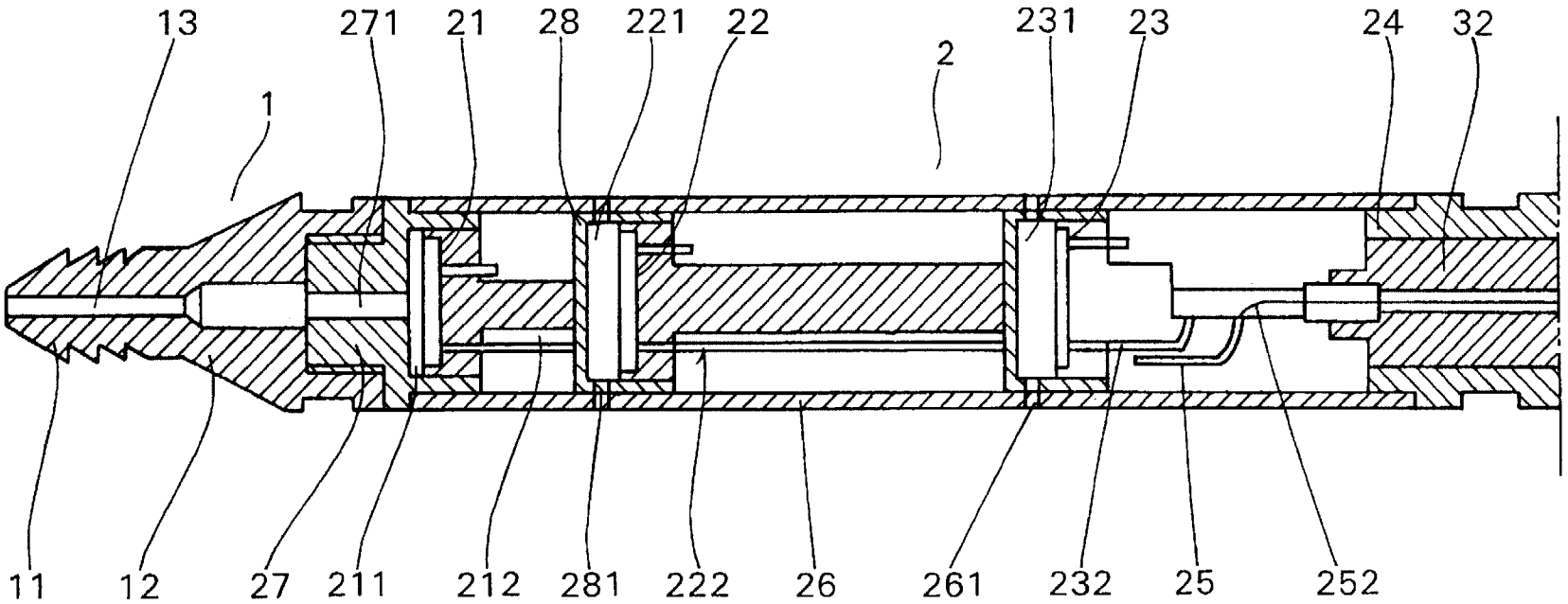
FIG. 1A and FIG. 1B are vertical section views of the device according to the present invention, and respectively show the upper part and lower part of the device in detail.
Figure 1B:
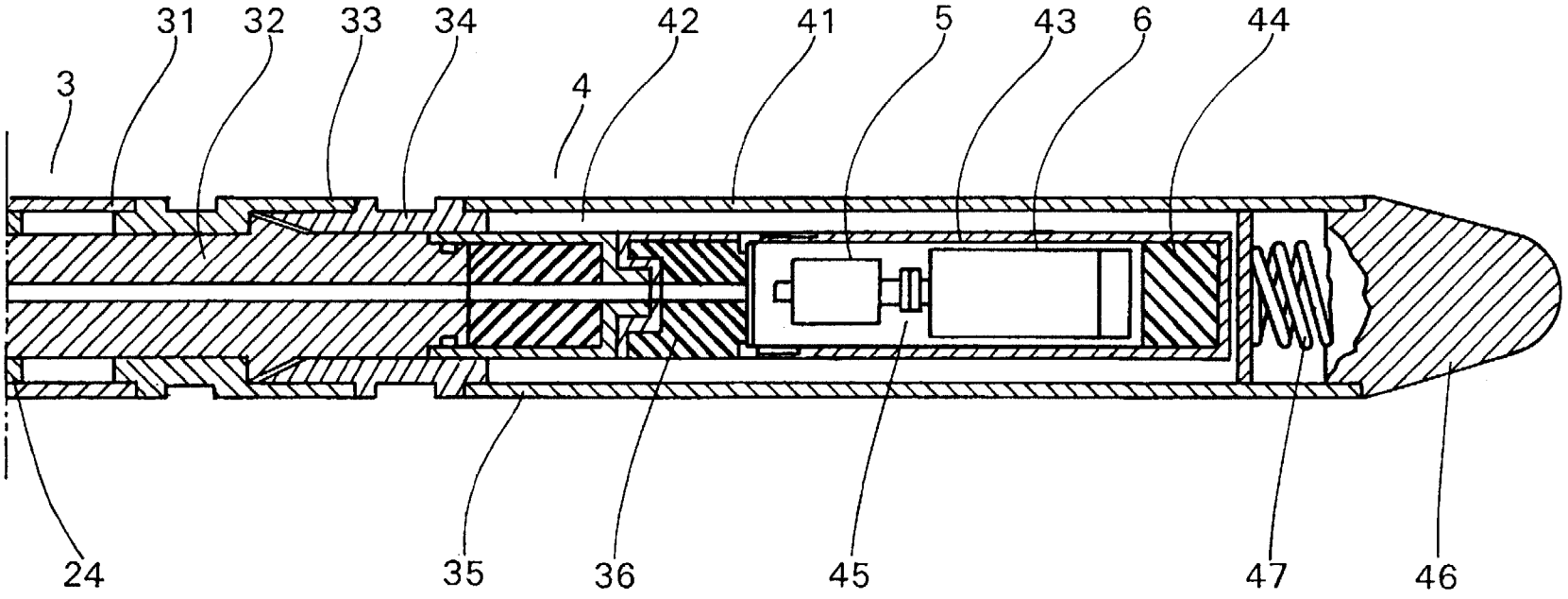

As shown in FIGS. 1A and 1B, the device according to the present invention comprises a cable cap 1 which is located at the top of the device, a measuring section 2 adjacently next to the cap 1, a thermal protection section 3 connected to the lower part of the measuring section 2, and a thermal isolating section 4 connected to the lower part of the section 3.

The cable cap 1 consists of an upper part 11 in a reduced diameter and a lower part 12 in an enlarged diameter, through which a central hole 13 is formed. The cable (not shown) used for hanging the device can go through and be fixed in the hole 13.

On the outer surface of the upper part 11 is teeth formed and used for easily applying forces on the device by a dragging tool, when the cable is broken and the device falls into a well bore.

The present invention is used in a measuring system to obtain the data of the pressure, temperature, flow rate and steam quality of a steam injection profile by using the theory of two phase flows of steam and liquid and no flute shaped probe is required.

The measuring section 2 has a metal case 26 which has a good thermal conduction. In the case 26, three pressure sensors 21, 22 and 23 for pressure measurement and a thermoelectric couple 25 for temperature measurement are arranged. In this embodiment, diffused silicon pizeoresistive sensors are used as the pressure sensors and the description below refers to them as membrane cells. A top lid 27 and a lower lid 24 are provided at two ends of the case 26. A hole 271 is provided in the center of the top lid 27 so that the inner of the case 26 communicates with the outside. The three membrane cells 21, 22, 23 are arranged in the case 26 separately spatially in a longitudinal direction. Sensing spaces 211, 221, 231 are provided on the top surface of the strain membrane of cells by the upper lid 27 or isolation lids 28, and are isolated from the other parts in the case 26. Holes 281 are formed in the side wall of the isolation lids 28 for communication between the sensing spaces 221, 231 and the outside. Holes 261 are formed in the side wall of the case 26 which correspond respectively to the holes 281 in the isolation lids 28 of the membrane cells 22 and 23. Through the holes 281 and 261, the sensing spaces 221, 231 are in fluid communication with the outside. A similar sensing space 211 on the top surface of the membrane cell 21 is provided by the upper lid 27, which is open to the outside through the hole 271 in the upper lid 27.

The measuring section 2 connects to the cable cap 1 in such a manner that the upper lid 27 attaches to the cable cap 1 with thread. The central hole 13 of cable cap 1 is in alignment with the hole 271, whereby the sensing space 211 of the membrane cell 21 is in fluid communication with the outside of the device.

It shall be noted that the diameter of the hanging cable is less than that of the central hole 13 so as to obtain an adequate gap clearance for fluid communication from the sensing space 211 of the membrane cell 21 to the outside of the device.

The thermoelectric couple 25 is arranged between the membrane cell 23 and the lower lid 24. Since the case 26 is made of metal material, for example stainless steel, with a good conduction, the thermoelectric couple 25 is able to accurately measure the temperature outside of the device even through the thermocouple is placed in the case 26. Pressure and temperature data measured by the cells 21, 22, 23 and the thermoelectric couple 25 are respectively transmitted to the isolating section 4 through capillary tubes 212, 222, 232 and wires 252.

The thermal protection section 3 comprises a plug fitting member 33 connected to the lower lid 24 through a ring 31, a plug 34 used for plugging a vacuum chamber 42 (described below), and a thermal protection core 32 extending through the lower lid 24, the ring 31, the plug fitting member 33 and the plug 34. The thermal protection core 32 is used to guide and protect the capillary tubes and the wires from the measuring section 2. The sections of the capillary tubes and wires extending in the section 3 is not shown in FIG. 1B for clearance. The upper part of the core 32 (the section on the left of FIG. 1B) is made of metal to ensure the strength of the whole device, and the lower part is full with heat absorption agent 36 and extends into the vacuum chamber 42 to seal a cup 43 and prevents heat of the upper part of the core 32 from transmitting to the thermal isolating section 4.

Figure 2:
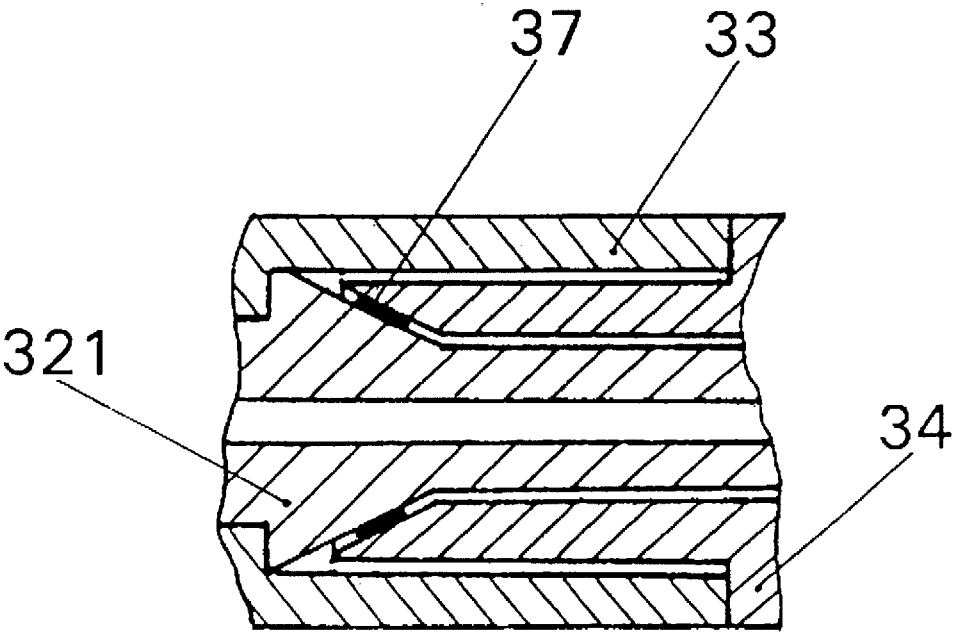
FIG. 2 is a view of the taper fitting structure of the plug used in the thermal protection section.

As shown in FIG. 2, the plug 34 is generally a hollow cylinder. The upper part of its inner hole has a gradually enlarged diameter. A section 321 with a gradually enlarged diameter is also formed in the metal part of the thermal protection core 32 to fit to the upper part of the inner hole of the plug 34. Taper fitting structure between the section 321 and the upper part of the inner hole of the plug 34 ensures an air-tight joint of the plug 34 and the core 32. Therefore, the vacuum chamber 42 in the thermal isolating section 4 rests in a desired vacuum. In addition, an additional sealing washer 37 made of red copper may be arranged between the core 32 and the plug 34.

The thermal isolating section 4 comprises a case 41 with a head 46 and the cup 43 having an inner chamber 45. In the chamber 45 are arranged a sensor group 5 and a data conversion and storage system 6 under the control of a single chip processor. The space between the inner surface of case 41 and the outer surface of cup 43 is pumped to be the vacuum chamber 42, which is tightly sealed by the plug 34 as mentioned above to ensure that the temperature in the inner chamber 45 will not exceed 40 centigrade degrees after the device works at least for 6 hours under 350 centigrade degrees in a steam injection well. Further, the cup 43 is made of metal such as stainless steel and has another function to ensure an even temperature distribution in the chamber 45 when local temperature rises due to some working electronic components inside the chamber 45. A spring 47 between the cup 43 and the head 46 is designed to reduce vibration of the cup 43.

Figure 3:
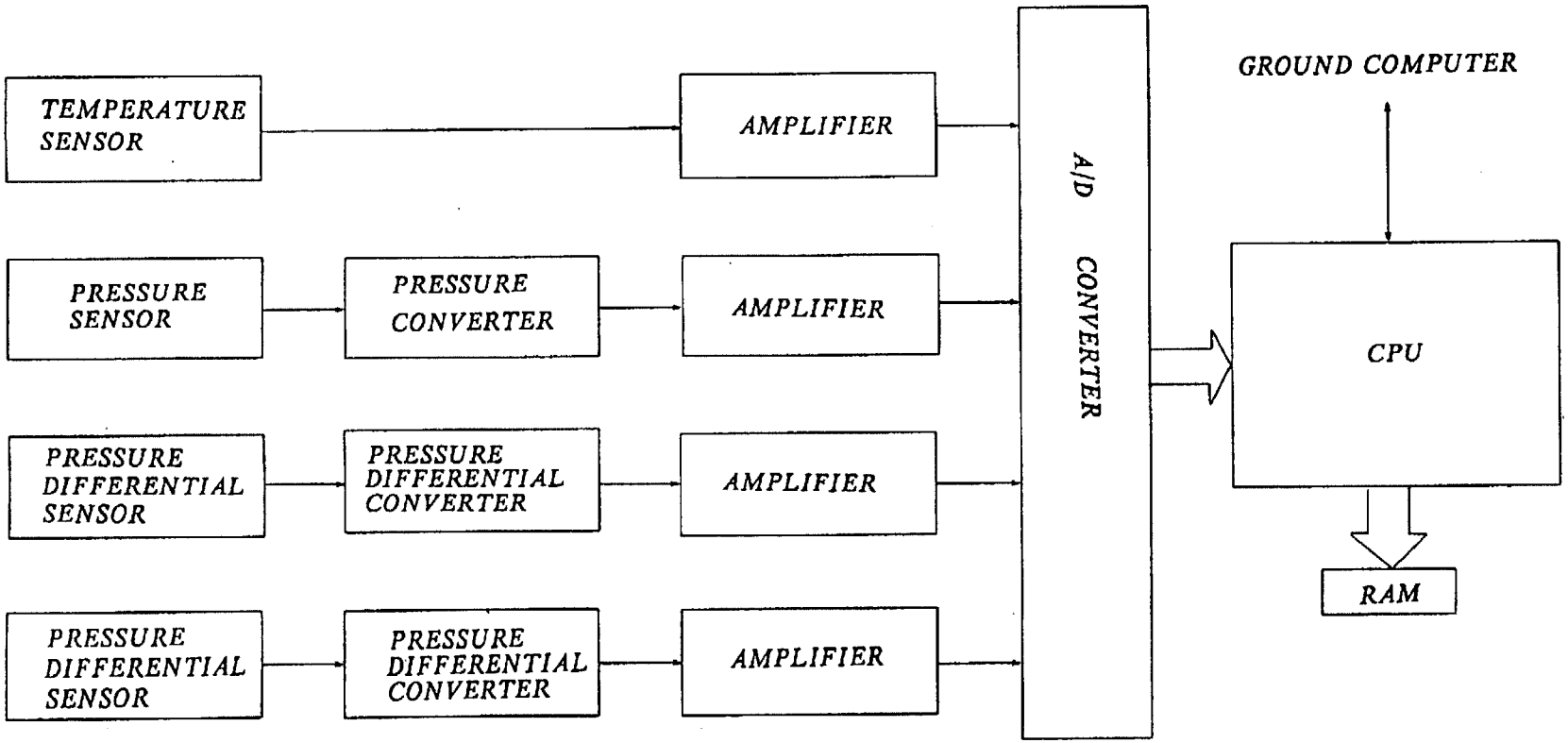
FIG. 3 shows the working principle of sensors and a downhole data acquisition, conversion and storage system under the control of a single chip processor.
Figure 4:
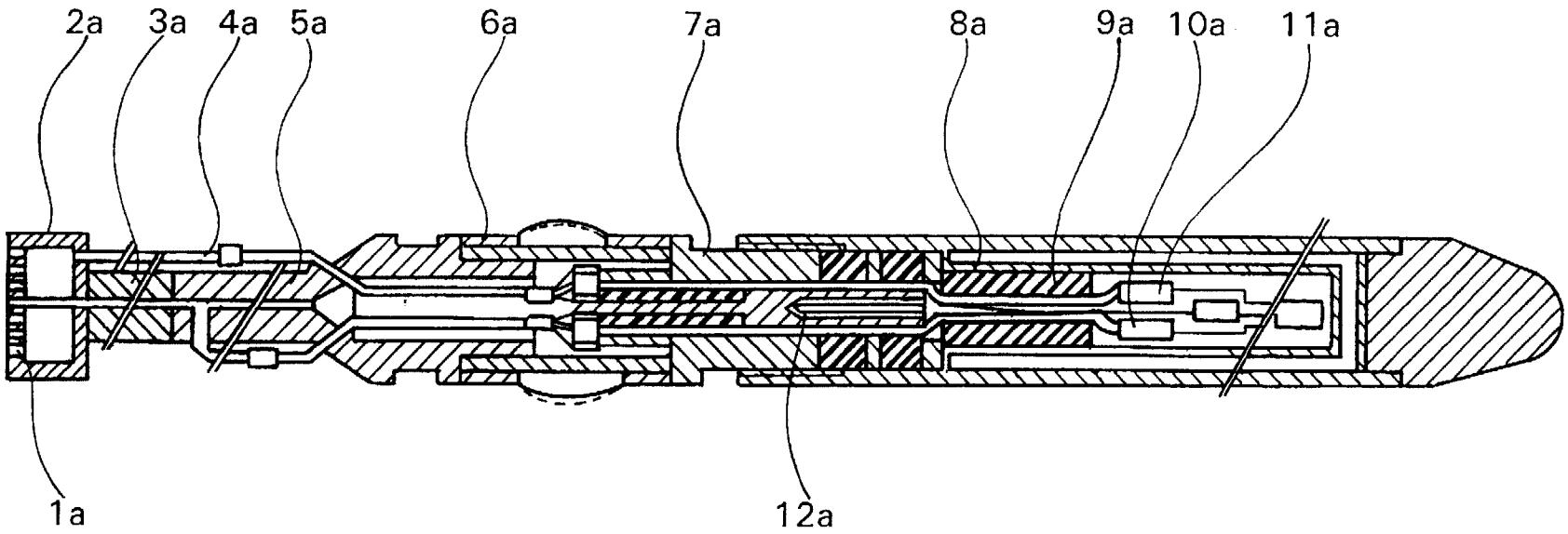
Fig. 4 (PRIOR ART)
FIG. 4 is a vertical section view of a prior art device.

The sensor group 5 (FIG. 3) consists of a temperature sensor, a pressure sensor and two pressure differential sensors. Each pressure differential sensor has a similar structure to that of the pressure sensor, except to produces a pressure differential data by receiving and comparing the data from two membrane cells at the same time. A pressure converter and two pressure differential converters convert the pressure data from the sensors in the group 5 into digital signals and stored them in RAM under the control of the single chip processor. The temperature data from the temperature sensor is also stored in RAM.

In practice, the measuring device according to the present invention is hung into a well bore by the cable. The annular space between the device and well bore is taken as a throttling element. The pressure data P1, P2 and P3 are measured respectively by the three membrane cells 21, 22 and 23 and the temperature data is simultaneously measured by the thermoelectric couple 25. The data is respectively transmitted to the sensor group 5 through the capillary tubes 212, 222, 232 and the wires 252, in which P1 obtained by the membrane cell 21 is transmitted to the pressure sensor of the sensor group 5 as a static pressure data. P1 and P2 produced by the membrane cells 21 and 22 are transmitted to one of the pressure differential sensors to produce a differential pressure data ΔP1, and the P2 and P3 produced by membrane cells 22, 23 are transmitted to another pressure differential sensor to produce a second pressure differential data ΔP2. The temperature data obtained by the thermoelectric couple 25 is transmitted to the temperature sensor. These pressure, pressure differential and temperature data are amplified, filtered, A/D converted and stored by the data conversion and storage system 6. When the device is pull out of the well bore, the ground computer provides an output based on the data stored not only of temperature and pressure values, but also the values of flow rate and stem quality according to a digital model of the theory of two phase flows of steam and liquid.

While the description of the invention has been given with respect to a preferred embodiment, it is not be constructed in a limited sense. Variation and modification will occur to those skilled in the art. Reference is made to the appended claims for a definition of the invention.

We claim:

1. A measuring device adapted to be lowered into a borehole from a ground surface and used in a four parameter measuring system for measuring simultaneously temperature, pressure, flow rate and steam quality of steam injection profiles during heavy oil recovery from said borehole by steam injection, the measuring device comprising:

a cable cap (1), arranged at the top of the device;

a measuring section (2), connected with said cable cap (1) and comprising a metal case (26), three pressure sensors (21, 22, 23) for pressure measurement, and a thermoelectric couple (25); said pressure sensors (21, 22, 23) and said thermoelectric couple(25) being longitudinally arranged and spatially separated in said case (26); isolation lids (28) being attached on two of said pressure sensors (22, 23) to form two respective sensing spaces (221, 231) in a contiguous volume disposed between each of said lids and each of said pressure sensors (22, 23) for said two sensors; said two sensing spaces (221, 231) being airtightly sealed from other parts in said case (26); a plurality of holes (261, 281) formed respectively in said isolation lids (28) and said case (26) for allowing fluid communication of said sensing spaces (221, 231) to the surrounding environment;

a thermal protection section (3), connected to the lower part of said measuring section (2) and used for safe transmission of data measured by said pressure sensors (21, 22, 23) and said thermoelectric couple (25); and a thermal isolating section (4), connected to the lower part of said thermal protection section (3), the thermal isolating section (4) including an enclosed chamber having therein a data acquisition, conversion and storage system (5, 6) comprising;

a pressure sensor for receiving the pressure data measured by one of said measuring section pressure sensors (21, 22, 23), a plurality of pressure differential sensors for receiving pressure data measured by two of said measuring section pressure sensors (21, 22, 23) and producing pressure differential data therefrom, a temperature sensor for receiving temperature data measured by said thermoelectric couple (25), and a conversion and storage system under the control of a single-chip processor, whereby the pressure and temperature data measured respectively by said measuring section pressure sensors (21, 22, 23) and said thermoelectric couple (25) are transmitted to said data acquisition, conversion and storage system (5, 6) and stored therein, so that the temperature, pressure, flow rate and steam quality of injected steam can be calculated according to the theory of two phase flows of steam and liquid after the device is raised through said borehole in its return to the ground.

2. A device as claimed in claim 1 wherein, said measuring section (2) further comprises an upper lid (27) and a lower lid (24), which are attached at the ends of said measuring section (2) and a hole (271) formed in said upper lid (27) for allowing air to fluidly communicate from inside said case (26) to the surrounding environment; wherein said upper lid (27) and the uppermost measuring section pressure sensor (21) form a sensing space.

3. A device as claimed in claim 2, wherein said cable cap (1) is at the top of the device and includes an upper part (11) with a reduced diameter; a lower part (12) with an enlarged diameter; a central hole (13) extending through said cable cap (1); and a plurality of teeth on the outer surface of said upper part (11).

4. A device as claimed in claim 2, wherein said thermal isolating section (4) includes a case (41) and a cup (43) made of material having good thermal conductivity; and a vacuum chamber (42) formed between the inner surface of said case (41) and the outer of said cup (43) and airtightly sealed.

5. A device as claimed in claim 4, wherein said thermal protection section (3) comprises a plug fitting member (33) connected to said lower lid (24) through a ring (31), a plug

(34) used for plugging said vacuum chamber (42), and a thermal protection core (32) with its upper part being made of metal and its lower part being filled with a heat absorption agent (36).

6. A device as claimed in claim 5, wherein said plug (34) is a hollow cylinder and the upper part of the inner hole of said plug (34) has a gradually enlarged diameter; and a section (321) with a gradually enlarged diameter is formed in said thermal protection core (32) and fits in the upper part of the inner hole of said plug (34), so that there is a taper fitting structure between said section (321) and the upper part of the inner hole of said plug (34).

7. A device as claimed in claim 6, wherein a sealing washer is provided between said section (321) and the upper part of the inner hole of said plug (34).

8. A device as claimed in claim 7, wherein said sealing washer is made of red copper.

9. A device as claimed in claim 1, wherein said measuring section pressure sensors, said data acquisition pressure sensor and said pressure differential sensors each comprise a diffused silicon piezoresistive sensor.

10. A device as claimed in claim 4, wherein each of said cases (26, 41) and said cup (43) are made of stainless steel.

* * * * *